US006164755A

United States Patent [19]

Yamamoto

[11] Patent Number: 6,164,755

[45] Date of Patent: Dec. 26, 2000

[54] DEVICE HAVING SCANNING-TYPE CARRIER AND PRINTING APPARATUS

[75] Inventor: Kosuke Yamamoto, Yokohama, Japan

[73] Assignee: Canon Kabushiki Kaisha, Tokyo, Japan

[21] Appl. No.: 08/812,084

[22] Filed: Mar. 6, 1997

[30] Foreign Application Priority Data

Mar. 8, 1996 [JP] Japan ..... 8-051934

[51] Int. Cl.[7] ..... B41J 23/00

[52] U.S. Cl. ..... 347/37

[58] Field of Search ..... 347/37, 7, 14, 347/43

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,992,805 | 2/1991 | Yoshizawa et al. | 346/134 |
| 5,777,634 | 7/1998 | Okamura et al. | 347/7 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |
| 8-25653 | 1/1996 | Japan . |

*Primary Examiner*—John Barlow
*Assistant Examiner*—Juanita Stephens
*Attorney, Agent, or Firm*—Fitzpatrick, Cella, Harper & Scinto

[57] ABSTRACT

In consideration of a coupling condition between a carriage having a functional element, such as a printing head, and a carrier for moving the carriage, position control therefor is performed appropriately for improving printed image quality and satisfactorily obtaining the function of the functional element. With respect to a scanning body as the carrier, a carriage for black ink and a carriage for color ink are selectively coupled by a gripper. Sensor blocking plates are respectively provided on the scanning body and the carriages. On the basis of a timing, at which the sensor blocking plate blocks an optical path of a home position sensor provided at a predetermined position of a main body of an apparatus, a correction amount for position control corresponding to a coupling play of the carriage relative to the carrier is derived.

27 Claims, 12 Drawing Sheets

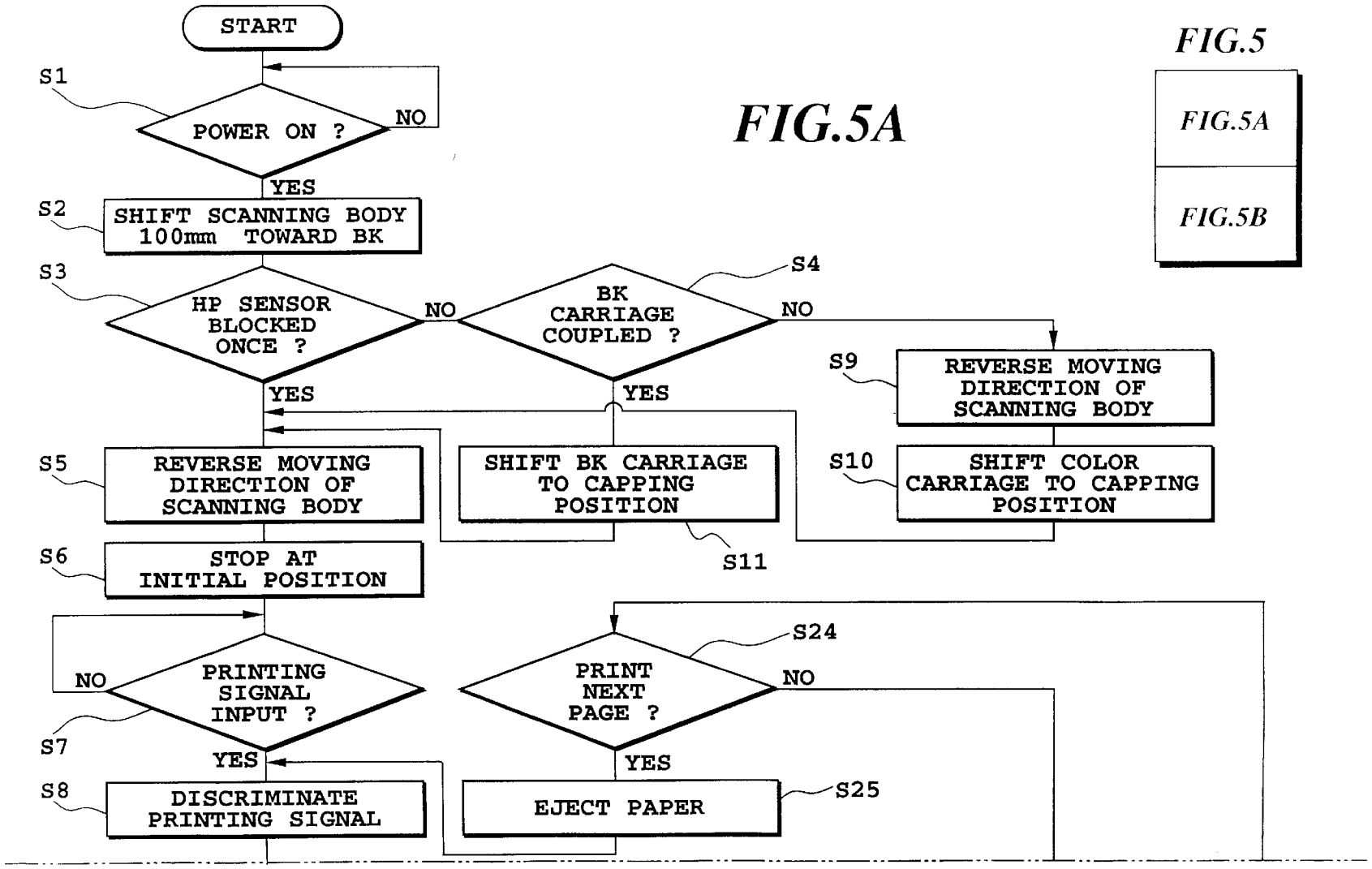
FIG.5
FIG.5A
FIG.5B
FIG.5A
START
POWER ON ?
NO
YES
S1
SHIFT SCANNING BODY 100mm TOWARD BK
S2
HP SENSOR BLOCKED ONCE ?
NO
YES
S3
BK CARRIAGE COUPLED ?
NO
YES
S4
REVERSE MOVING DIRECTION OF SCANNING BODY
S9
SHIFT COLOR CARRIAGE TO CAPPING POSITION
S10
SHIFT BK CARRIAGE TO CAPPING POSITION
S11
REVERSE MOVING DIRECTION OF SCANNING BODY
S5
STOP AT INITIAL POSITION
S6
PRINTING SIGNAL INPUT ?
NO
YES
S7
DISCRIMINATE PRINTING SIGNAL
S8
PRINT NEXT PAGE ?
NO
YES
S24
EJECT PAPER
S25

DEVICE HAVING SCANNING-TYPE CARRIER AND PRINTING APPARATUS

BACKGROUND OF THE INVENTION

1. Field of the Invention

The present invention relates to a device having a scanning type carrier suitable for scanning a printing head, read out sensor and other devices or elements as a functional element, and a printing apparatus.

2. Description of the Related Art

Conventionally, in an ink-jet printing apparatus performing printing by scanning an ink-jet printing head, there are some printing apparatus, each of which is provided with a transmission type optical sensor on a carriage mounting the ink-jet printing head and moving in a primary scanning direction, and a blocking plate for blocking an optical path of the optical sensor on a predetermined position of a main body of the apparatus. The optical sensor outputs a detection signal when the optical path thereof is blocked by the blocking plate. The printing apparatus is responsive to the detection signal to control a moving position of the carriage for fixing a printing start position in printing characters or the like, and for other operations. Conversely, there are alternative examples, in which the blocking plate is provided on the carriage and the optical sensor is provided on the main body of the apparatus.

On the other hand, the inventor has already proposed an ink-jet printing apparatus, in which two carriages mounting two different printing heads are selectively coupled to one scanning body as a carrier (Japanese Patent Application Laying-open No. 164432/1994). In such an apparatus, two carriages are selectively coupled to the carrier depending upon kind of document, such as a document primarily consisting of characters, a document, in which a character and graphic image are mixed, a document primarily consisting of graphic images and other documents, and perform high speed printing using the printing head on the carriage coupled to the carrier. In addition to this construction, a capping means for capping ink ejection openings of the printing head, a pump means with a tube extending within a range of motion of the scanning body for externally discharging an ink within the capping means, and a tube depressing means provided on the scanning body for squeezing the tube, may be provided. In this case, it becomes possible to perform a so-called recovery operation for maintaining the printing head in good condition, such as an operation for forcedly ejecting the ink through the ink ejection openings.

However, when the conventional carriage moving position control means is applied for the printing apparatus, in which the scanning body as the carrier and the carriages are provided separately, the following drawbacks are encountered.

At first, when the optical sensor is provided on one of the scanning body as the carrier or the main body of the printing apparatus, and the blocking plate is provided on the other, for controlling moving position of the carriage on the basis of the detection signal output upon blocking of the optical path of the optical sensor, the following problem can be caused. Namely, due to a certain amount of play between the scanning body and the carriage and a fluctuation in dimension of the scanning body, a printing position with respect to a paper as a printing medium can fluctuate significantly for each individual printing apparatus.

On the other hand, when bidirectional printing to perform printing in both a forward scanning movement and reverse scanning movement of the carriage, the following problem can arise. Namely, due to a difference of play amount between the scanning body and the carriage in the forward scanning motion and the reverse scanning motion, or a difference of driving condition, such as belt tension of a carrier driving belt in the forward scanning motion and in the reverse scanning motion, there may be a danger that the printing position in the forward scanning motion deviates from that in the reverse scanning motion. Such deviation of the printing position should result in degradation of image quality, such as fluctuation of character writing position or misalignment of rule lines. As a method for eliminating such fluctuation of the printing position, there is a method to shift ejection timing of the ink during the reverse scanning movement for a period corresponding to fluctuation of the printing position, in a case of bidirectional printing operation, for preventing the image quality from being degraded. In order to automatically calculate the period (bidirectional correction amount) corresponding to the fluctuation of the printing position, the detection signal of the optical sensor provided on one of the scanning body as the carrier or the main body of the apparatus may be used. For instance, with taking a timing of blocking of the optical path of the optical sensor as reference, a predetermined number of driving pulses are input to a pulse motor for scanning, and a time difference between the forward movement and the reverse movement when the scanning body is driven reciprocally in a magnitude corresponding to the predetermined number of driving pulses, is derived. The time difference thus derived is set as the bidirectional correction amount. However, in this case, the correction amount does not contain the error component between the scanning body and the carriage. Therefore, accurate bidirectional correction is difficult to satisfactorily prevent degradation of quality of the printed image. Such a drawback may be resolved by providing the optical sensor on one of the carriage and the main body of the apparatus, and the blocking plate on the other. However, in such a case, another new problem can arise in that when the scanning body is solely moved such as upon the foregoing recovery operation, an initial setting of the moving position and accurate control of the moving position of -the scanning body, i.e. carrier, becomes impossible.

SUMMARY OF THE INVENTION

It is an object of the present invention to provide a device having a scanning type carrier and a printing apparatus which permits accurate position control with taking the coupling condition of a carriage having a functional element, such as a printing head, and a carrier for moving the carriage, and whereby makes the function of the functional element satisfactorily effective, such as enhancement of the quality of a printed image.

In a first aspect of the present invention, there is provided a device having a scanning type carrier, which includes a scanning type carrier for performing a scan with receiving a driving force and a carriage which can be coupled to and released from the carrier, and can mount a functional element, comprising:

detecting means for detecting the carriage in coupled condition with the carrier, when the carrier passes a predetermined reference position in a scanning direction of the carrier; and control means for controlling scan of the carrier on the basis of a detection timing of the detection means while the functional element is in active state.

In a second aspect of the present invention, there is provided a device having a scanning type carrier, which includes a scanning type carrier for performing a scan with receiving a driving force and a carriage which can be coupled to and released from the carrier, and can mount a functional element, comprising:

detecting means for detecting the carrier passing a predetermined reference position in a scanning direction of the carrier; and control means for controlling scan of the carrier on the basis of a detection timing of the detection means while the carriage is not coupled to the carrier.

In a third aspect of the present invention, there is provided a printing apparatus, which includes a scanning type carrier receiving a driving force for performing a scan in a primary scanning direction, a transporting means for transporting a printing medium along an auxiliary scanning direction substantially perpendicular to the primary scanning direction, a carriage which can be coupled to and released from the carrier, and can mount a printing head which can perform printing to the printing medium, comprising:

detecting means for detecting the carriage passing a predetermined reference position in the primary scanning direction of the carrier while the carriage is coupled to the carrier; and control means for controlling the scan of the carrier on the basis of a detection timing of the detecting means while printing is performed on the printing medium using the printing head.

In a fourth aspect of the present invention, there is provided a printing apparatus, which includes a scanning type carrier receiving a driving force for per forming a scan in a primary scanning direction, transporting means for transporting a printing medium along an auxiliary scanning direction substantially perpendicular to the primary scanning direction, a carriage which can be coupled to and released from the carrier, and can mount a printing head which can perform printing to the printing medium, comprising:

detecting means for detecting the carrier passing a predetermined position in a scanning direction of the carrier; and control means for controlling scan of the carrier on the basis of a detection timing of the detecting means while the carriage is not coupled to the carrier.

According to the present invention, by permitting coupling and separating of the carriage mounting the functional element, such as the ink-jet head, to and from the carrier which receives a driving force and performs scanning. Scanning of the carrier is controlled based on the detection timing, at which the carriage passes across the predetermined reference position. By this, when the functional element is the printing head, for example, the scanning position of the printing head relative to the printing medium can be controlled with high precision to restrict a fluctuation of the printing start position relative to the printing medium and whereby to permit printing of a high quality image.

Also, when the carriage is reciprocally scanned together with the carrier, by performing scanning control for the carrier with taking a coupling condition between the carriage and the carrier into account, printing of high quality image without misalignment of vertical rule lines or the like when the functional element is the printing head.

Furthermore, the first and second carriages can be coupled to and released from the carrier. By this, the functional element mounted on respective of two carriage may satisfactorily and effectively perform their own functions.

BRIEF DESCRIPTION OF THE DRAWINGS

The present invention will be understood more fully from the detailed description given herebelow and from the accompanying drawings of the preferred embodiment of the invention, which, however, should not be taken as limiting the present invention, but are for explanation and understanding only.

In the drawings:

FIGS. 5A and 5B are flowcharts for explaining an operation of the first embodiment of the printing apparatus according to the present invention;

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however to those skilled in the art that the present invention may be practiced without these specific details. In other instances, well-known structures are not shown in detail in order to not unnecessarily obscure the present invention.

First Embodiment

Figure 1:
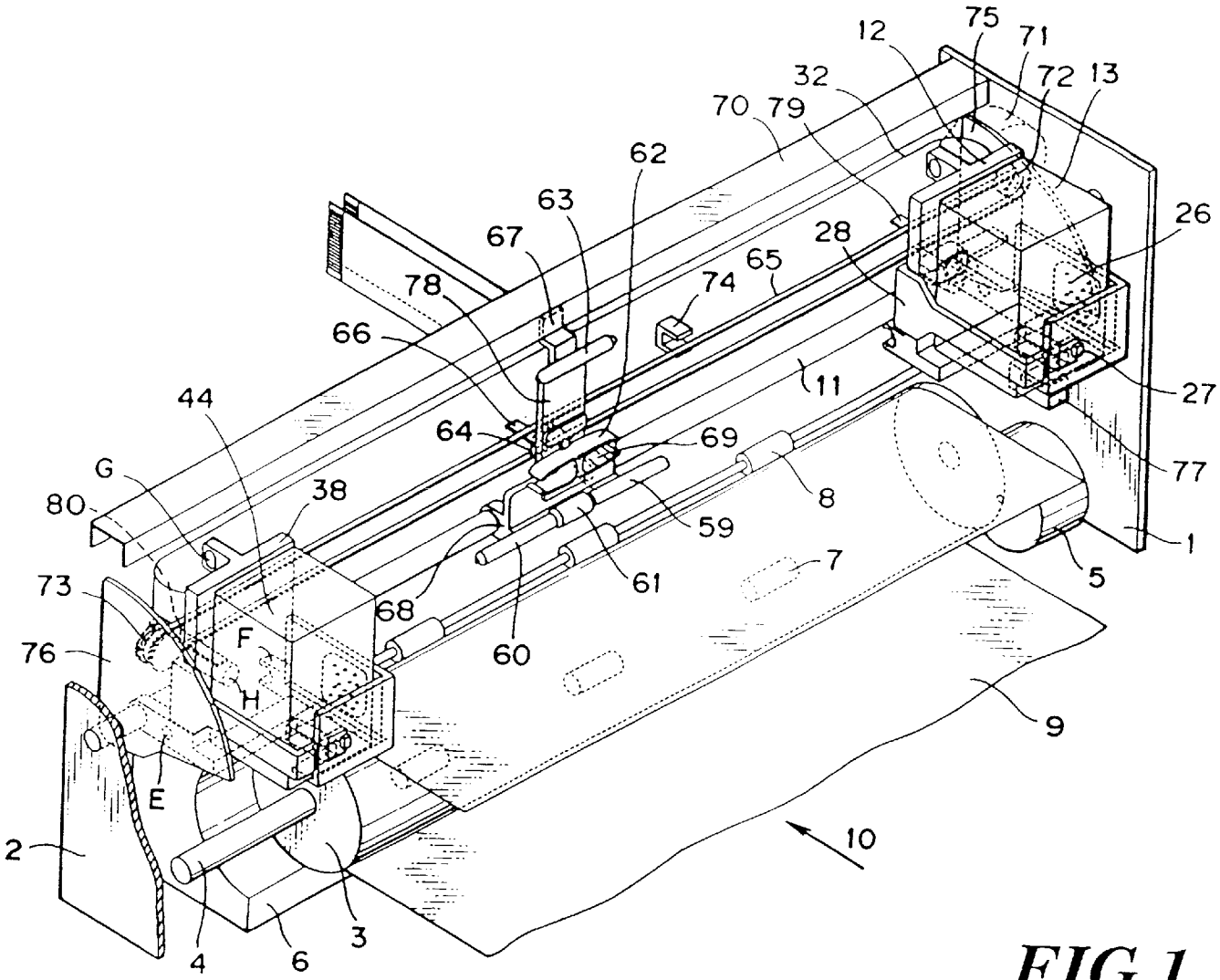
FIG. 1 is a perspective view of the overall construction of the first embodiment of a printing apparatus according to the present invention.

The first embodiment of the present invention will be described with reference to FIGS. 1 to 10. The first embodiment is an example of an application for an ink-jet printing apparatus. FIG. 1 is a perspective view showing the overall construction of the first embodiment.

The reference numeral 1 denotes a right side plate, 2 denotes a left side plate, 3 denotes a platen roller which is formed of an elastic body, such as rubber. The reference numeral 4 denotes a platen roller shaft formed on the center of the platen roller 3, which has left and right ends supported by the right side plate 1 and the left side plate 2. The reference numeral 5 denotes a paper feeder motor supported on the right side plate 1 and drives the platen roller shaft 4 via a gear train (not shown). The reference numeral 6 denotes a paper guide provided along the circumference of the platen roller 3. The reference numerals 7 and 8 are pinch rollers pressed onto the surface of the platen roller 3 under a predetermined pressure by a spring (not shown). A printing paper 9 as a printing medium is inserted between the platen roller 3 and the paper guide 6 in a direction shown by an arrow 10, and clamped between the pinch rollers 7 and 8 and the platen roller 3 to be bent in a substantially U-shaped configuration. The reference numeral 11 denoted a guide shaft having a diameter of 10 mm as a guide mechanism. The ends of the guide shaft 11 are supported on the right side plate 1 and the left side plate 2.

The reference numeral 12 denotes a carriage for a black ink as the carriage for mounting the functional element. Details of the carriage 12 for the black ink will be described hereinafter. On the carriage 12 for the black ink, a black ink cartridge 13 is mounted. The reference numeral 24 denotes a cartridge hook which serves for depressing the cartridge 13 onto a contact portion 26 positioned within the carriage 12. When a button 27 is depressed, an engaging portion 30 is released from a quadrangular opening 29 provided in the carriage 12. Then, the cartridge hook 24 is pivoted about a fulcrum 28 in a direction of 31. In the condition where the cartridge hook 24 is held open, the black ink cartridge 13 is inserted into the carriage 12 from the above. When the cartridge hook 24 is closed, the cartridge 13 is pushed toward the contact portion 26 to be fixed in a condition depressing the contact portion 26. From the carriage 12, pins 99 and 100 are projected. These pins 99 and 100 engage with positioning holes of an aluminum plate which is incorporated in the cartridge 13 and will be described later. The cartridge 13 is positioned so as to abut onto the root portions of the pins 99 and 100.

The reference numeral 32 denotes a flexible cable which can be curved according to movement of the carriage 12 and follows thereto. The flexible cable 32 is disposed within the carriage 12. The end of the flexible cable 32 is terminated at the contact point 26. The flexible cable 32 feeds an ink ejection signal as a driving signal of the functional element for the cartridge 13 through a substrate (not shown).

The carriage 12 has engaging holes 33, 34, and 35 for integration with a scanning body 78 as a carrier which will be described later, and a grip portion 36. The hole 35 is an elongated hole which is elongated in the vertical direction. The grip portion 36 is projected outwardly from the wall portion of the carriage 12. The reference numeral 37 denotes a hole provided on the carriage 12, through which the guide shaft 11 extends, which hole 37 is provided with an internal diameter of 10.2 mm so that a friction load may not be caused when the carriage 12 is integrated with the scanning body 78. By engagement of the hole 37 and the guide shaft 11, the carriage 12 is rockably supported on the guide shaft 11 as a guide mechanism. The carriage 12 is held in a condition restricting downward rocking motion at a portion above the cap 77 (see FIG. 1) which will be described later, as a first stand-by position. The reference numeral 79 denotes a sensor blocking plate for the black ink carriage, which sensor blocking plate can block the optical path of a light transmission type home position sensor 74 which will be described later.

Figure 2:
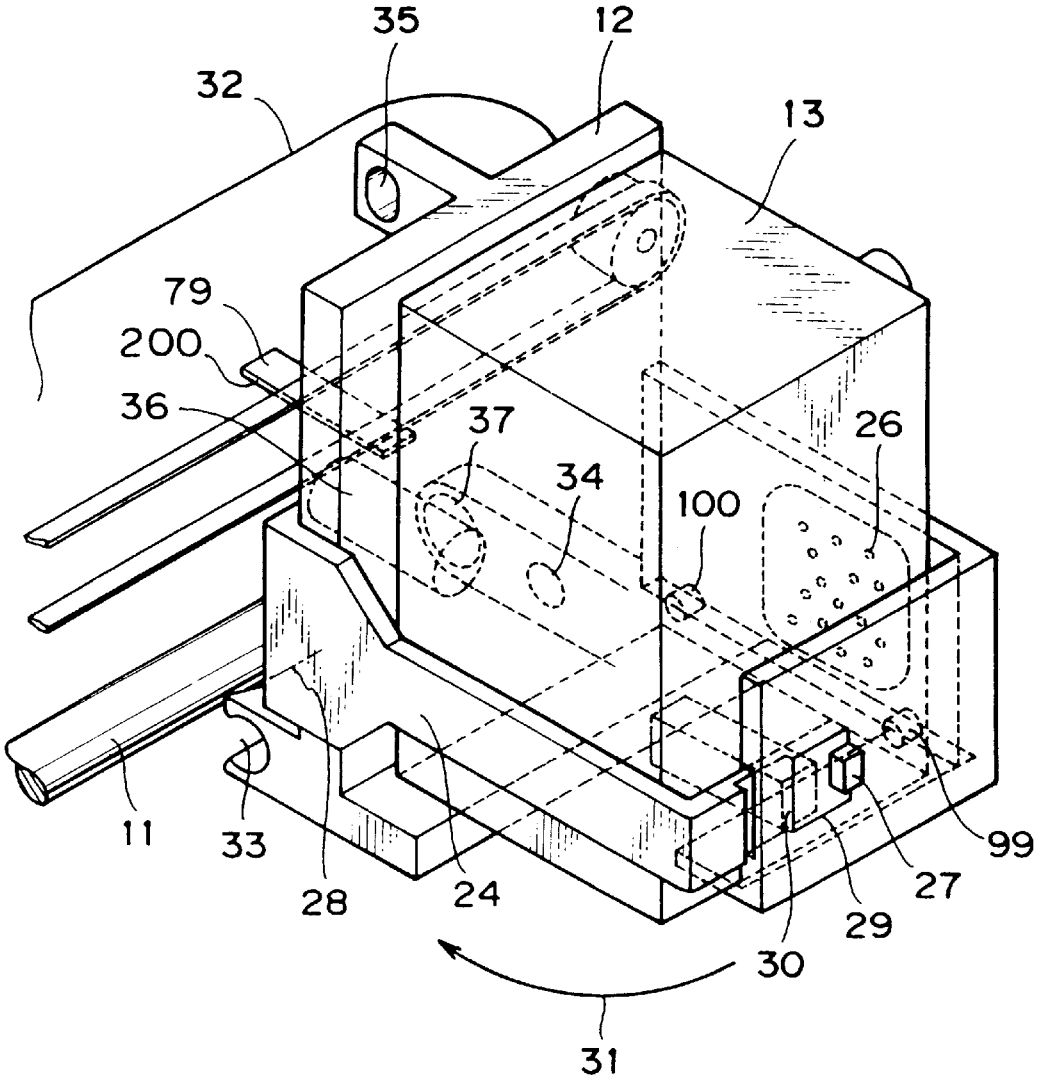
FIG. 2 is a perspective view of a carriage for a black ink, shown in FIG. 1.
Figure 3:
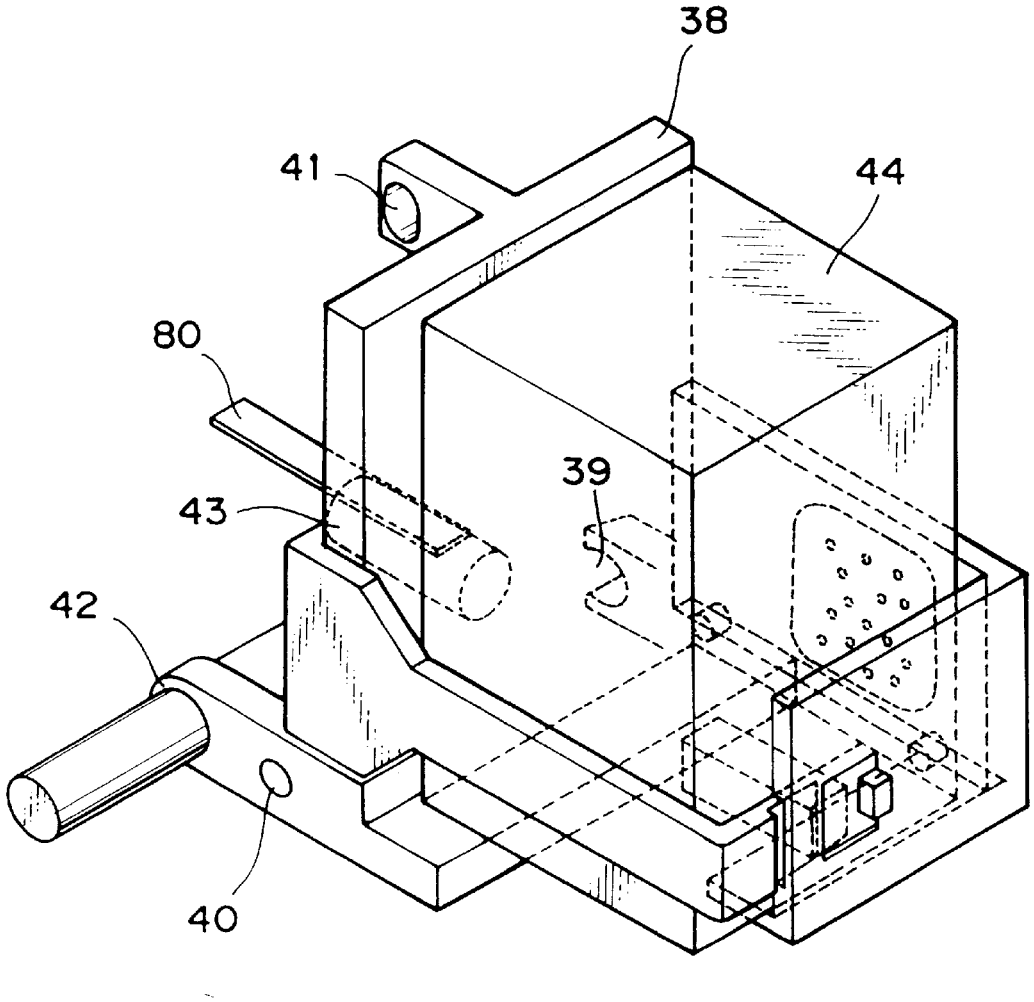
FIG. 3 is a perspective view of a carriage for a color ink, shown in FIG. 1.

In FIG. 1, the reference numeral 38 denotes a carriage for color ink, on which a color ink cartridge 44 is mounted. This carriage 38 will be explained with reference to FIG. 3. The carriage 38 has a similar configuration to the carriage 12 for the black ink as shown in FIG. 2, and only the different points will be explained. The reference numerals 39, 40 and 41 denote engaging holes for integrating with a scanning body 78 which will be described later. The positions of the engaging holes 39 and 40 are reversed left to right as compared with the engaging holes 33 and 34 of the carriage 12 for the block ink. The hole 41 is an elongated hole which is elongated in a vertical direction. The reference numeral 43 denotes a grip portion, which grip portion 43 projects externally from the wall portion of the carriage 38. The reference numeral 80 denotes a sensor blocking plate for the color ink carriage, which sensor blocking plate 80 can block the optical path of the light transmission type home position sensor 74. In the carriage 38, a hole 42 similar to the hole 37 of the carriage 12 is provided. By engagement of the hole 42 and the guide shaft 11, the carriage 38 is rockably supported on the guide shaft 11 as the guide mechanism. Also, in FIG. 1, on a position opposing the carriage 38, a cap similar to the cap 77 set forth above is provided. The upper surface portion of the cap is the first stand-by position, at which downward rocking motion of the carriage 38 is restricted.

The black ink cartridge 13 includes an ink tank storing the black ink and an ink-jet printing head as the functional element ejecting the black ink. The ink tank has a sponge (not shown) therein. In the sponge, the black ink is absorbed. A capacity of the ink tank is selected to contain the ink in amount permitting printing of characters on about 7010 sheets of printing papers 9 of A4 size, for example. On an aluminum plate (not shown) for heat radiation provided on the cartridge 13, a positioning hole with respect to the carriage 12 is provided. Also, in parallel to the aluminum plate, a substrate having a contact (not shown) corresponding to the contact portion 26 is fixed.

The color ink cartridge 44 includes a color ink tank storing a color ink and an ink-jet printing head for color ink, as a functional element ejecting the color ink. The color ink tank is different from the ink tank of the foregoing black ink cartridge 13 in that it can be removed from the ink-jet printing head for exchanging color ink. The construction within the color ink tank is similar to that of the ink tank for the black ink cartridge 13 and thus includes a sponge. In the interior of the color ink tank, storage regions for color inks of yellow, magenta, cyan and black are defined. From sponges disposed within these respective regions, respective color inks are supplied to the ink-jet printing head for color ink via ink supply openings.

Next, the scanning body 78 as the scanning-type carrier will be explained with reference to FIG. 1. In FIG. 1, left and right bearings 68 and 69 of the scanning body 78 are slidably engaged with the guide shaft 11. An upper guide 67 slides along a rail 70. The reference numeral 65 denotes a belt fixed to a belt stop 64 as a driving force receiving portion located at intermediate position in left and right direction of the scanning body 78. One side of the belt 65 is fitted around a motor pulley 72, and the other side is fitted around a tension pulley 73 which is biased by a spring (not shown) in a direction for applying tension to the belt 65. By driving a carrier motor 71, the scanning body 78 is reciprocally moved in the primary scanning direction along the guide shaft 11 and the rail 70. The reference numeral 66 denotes a sensor blocking plate provided on the scanning body 58. By blocking an optical path of the transmission type home position sensor 74 provided on the main body of the apparatus by the blocking plate 66, the sensor 74 outputs the signal for controlling a position of the scanning body 78.

Figure 7:
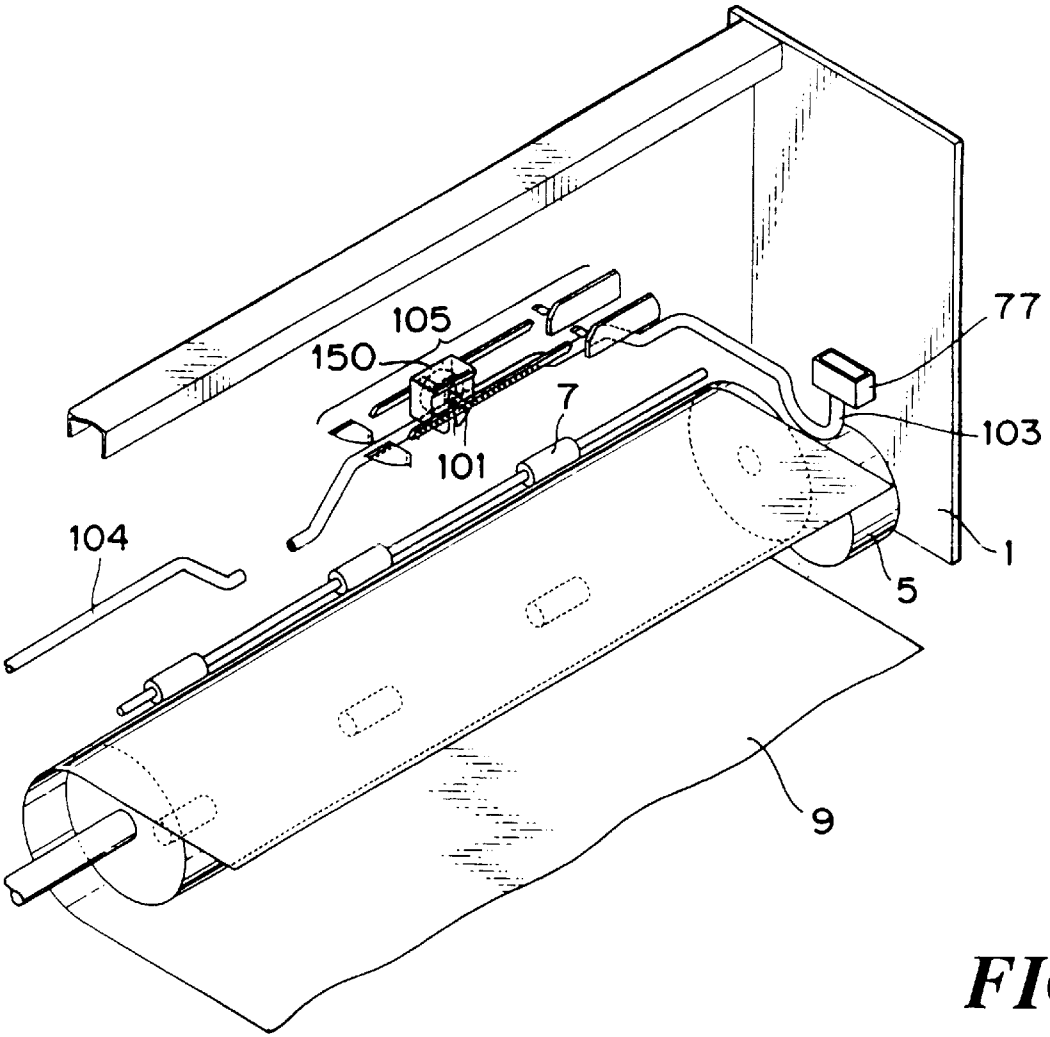
FIG. 7 is a perspective view of the major part for explaining a condition of arrangement of a tube connected to a cap shown in FIG. 1.
Figure 8:
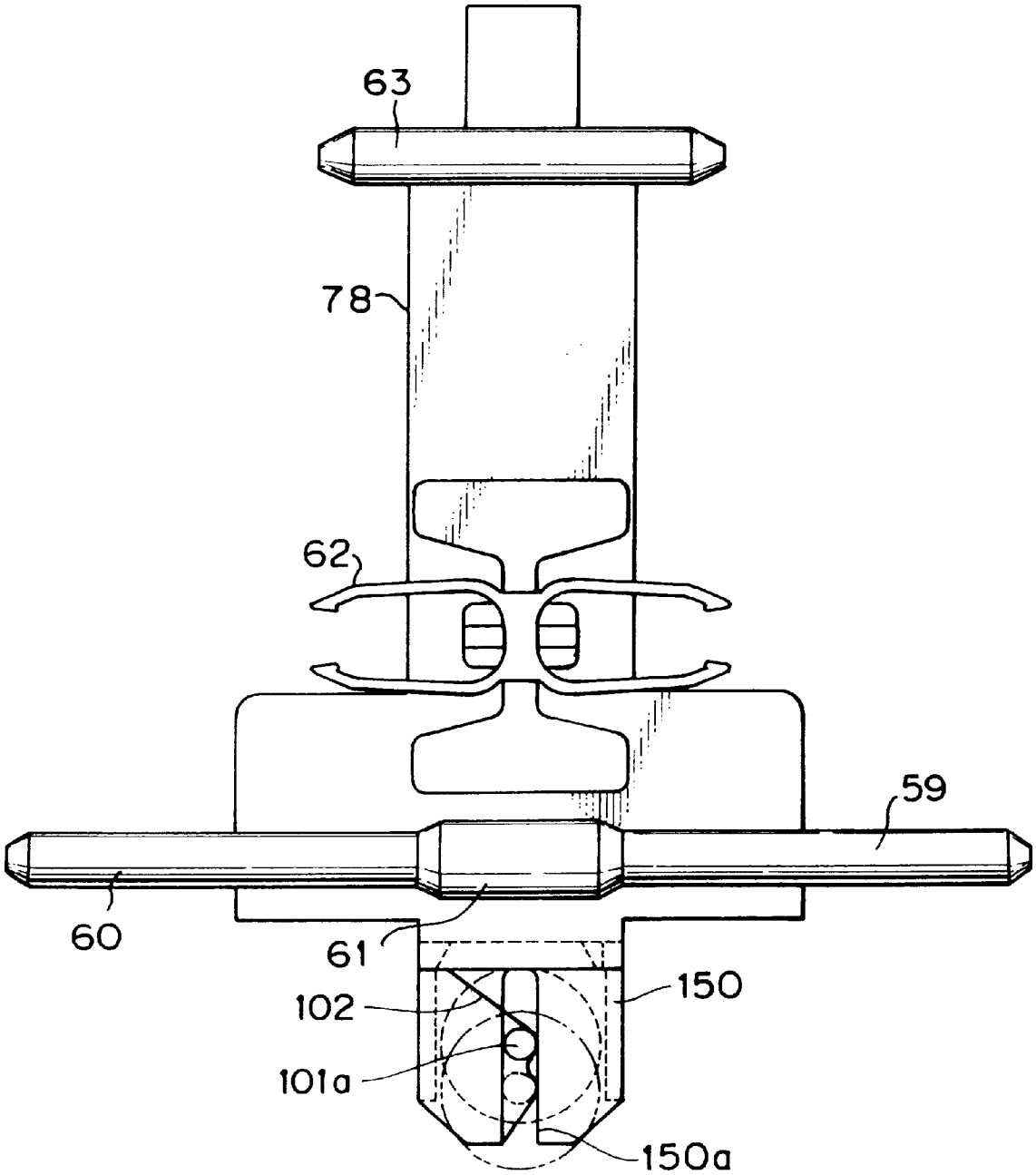
FIG. 8 is a front elevation of the major part for explaining a condition of arrangement of a roller shown in FIG. 7.

In FIG. 7, the reference numeral 101 denotes a roller as a depressing portion, which roller 101 is moveable in a vertical direction in FIG. 7. The reference numeral 105 denotes a cam formed with a member fixed to the main body of the printing apparatus and restricts vertical position of the roller 101. The roller 101 will be described with reference to FIG. 8. On a rearwardly extended portion 150 of the scanning body 78, a slit 150*a* extending in the vertical direction is formed. To the slit 150, a shaft (hereinafter referred to as "roller shaft") 101*a* of the roller 101 is engaged. The reference numeral 102 denotes a leaf spring fixed to the rearwardly extended portion 150 of the scanning body 78, which leaf spring 102 biases the roller shaft 101*a* toward the left in FIG. 7. The leaf spring 102 is formed with two bent portions as shown. These bent portions stably hold the roller 101 in stable condition at a first position shown by solid line or a second position shown by two dotted-line.

Figure 6:
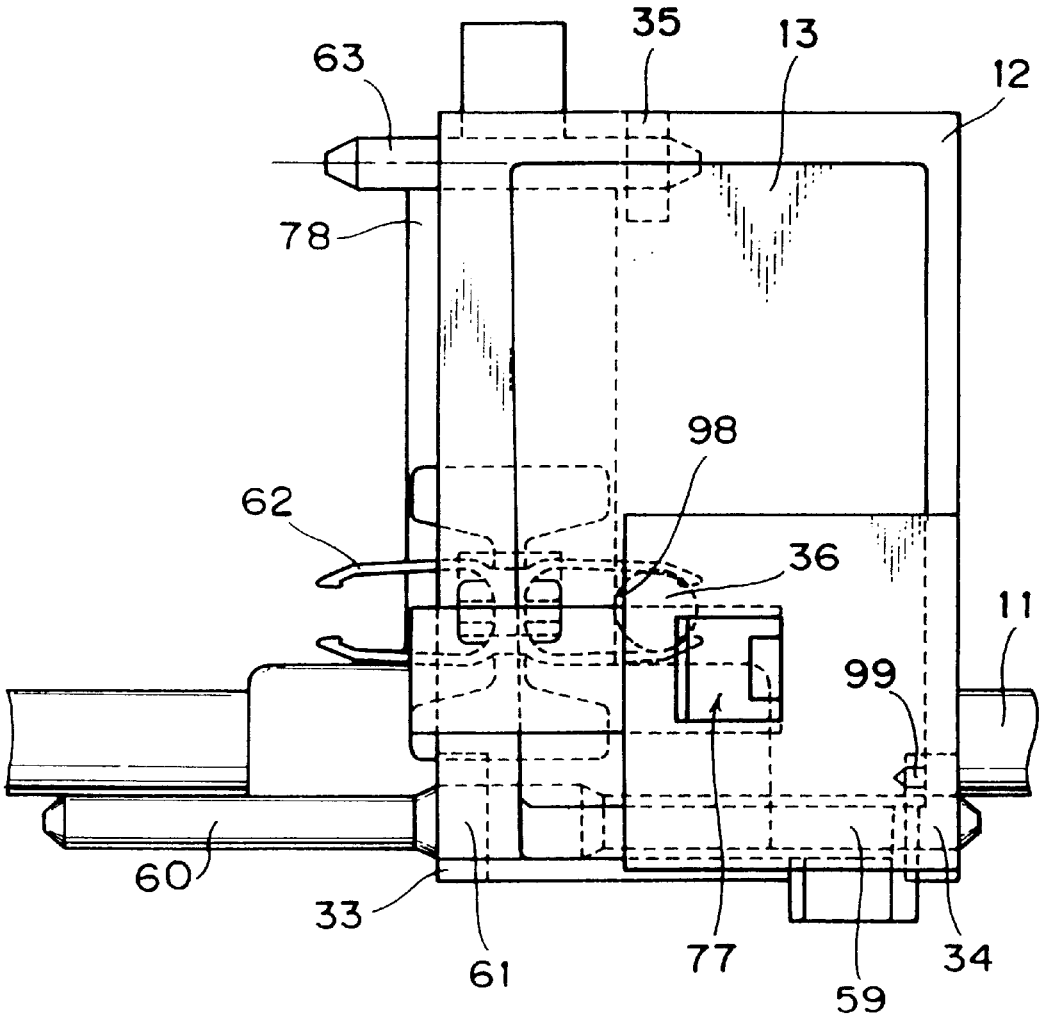
FIG. 6 is a front elevation for explaining a coupling condition between the carriage for the black ink and the carrier, as shown in FIG. 1.

The reference numeral 62 denotes a resin gripper fixed on the scanning body 78. The gripper 62 is designed to grip the gripping portions 36 and 43 of the carriage 12 for the black ink and the carriage 38 for the color ink by bifurcated claws. FIG. 6 is an illustration showing a coupled condition of the scanning body 78 and the carriage 12 for the black ink. The carriage 12 is held in a condition where the gripping portion 36 abuts a stopper portion 98 of the scanning body 78. Namely, the cartridge 13 is positioned on the carriage 12 in the condition abutting to the base ends of the positioning pins 99 and 100. Also, the carriage 12 is positioned on the scanning body 78 in the condition where the gripping portion 36 abuts against the stopper portion 98 of the scanning body 78. By this the printing head of the cartridge 13 is certainly positioned with respect to the scanning body 78 so that the printing head may perform printing on the accurate position in the paper 9. In the condition where the gripper 62 of the scanning body 78 grips the gripping portion 36 of the carriage 12 for the black ink, the engaging shafts 59, 61 and 63 are engaged with the engaging holes 34, 33 and 35, respectively, for scanning of the scanning body 78 and the carriage 12 in an integrated form. Similarly, upon integrating the carriage 38 for the color ink and the scanning body 78, the gripper 62 grips the gripping portion 36 and the engaging shafts 60, 61 and 63 are engaged with the engaging holes 40, 39 and 41, respectively, of the carriage 38 for integrally coupling the scanning body 78 and the carriage 38. The gripper 62 and the engaging shafts 59, 60, 61 and 63 form an engaging mechanism that restricts rocking motion of the carriages 12 and 38 when the carriages 12 and 38 are located above the cap in the first and second stand-by positions and engaged to the scanning body 78.

The reference numeral 75 denotes a resin black gripper for restricting the carriage 12 for the black ink at the position of FIG. 1. The reference numeral 76 denotes a resin color gripper for restricting the carriage 38 for the color ink at the position of FIG. 1.

The black gripper 75 and the color gripper 76 are shaped in a mirror-image relationship, and have the same operation. Therefore, a description is given only for the black gripper 75.

Figure 4A:
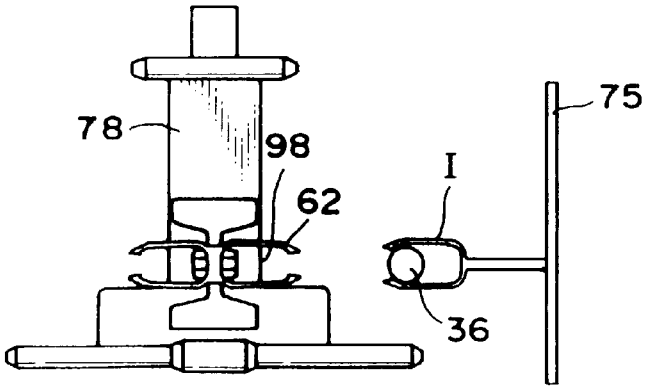
FIGS. 4A, 4B, 4C and 4D are front elevations of the major portion for explaining a coupling operation between the carriage for the black ink and the carrier, as shown in FIG. 1.
Figure 4B:
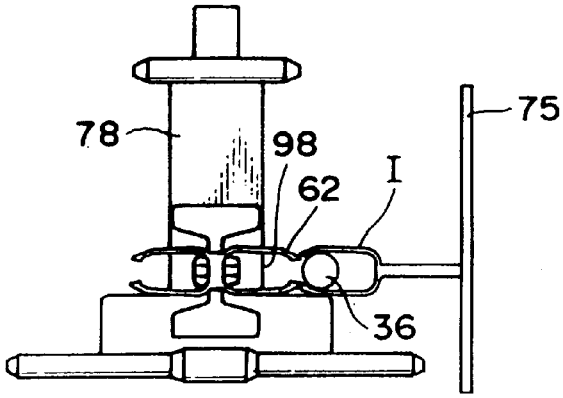
Figure 4C:
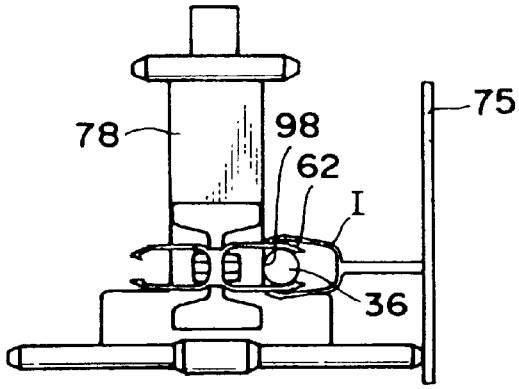
Figure 4D:
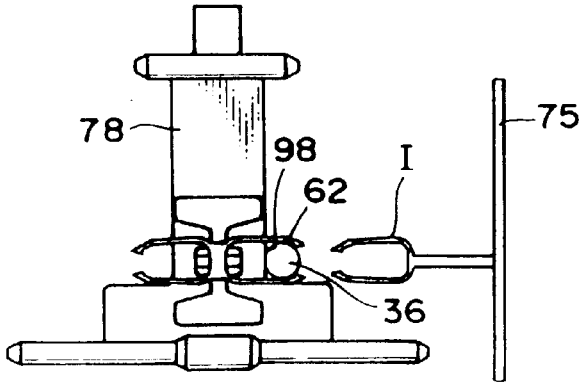

FIGS. 4A to 4D are front elevations showing relationship of the gripping portion 36 of the carriage 12 for the black ink, the gripper 62 and the black gripper 75, in which illustration of the carriage 12 is not shown. FIG. 4A shows a condition where the black gripper 75 is restricting the carriage 12. Bifurcated claw I of the black gripper 75 is gripping the gripping portion 36, and thus is resiliently deformed to open outwardly. FIG. 4B shows a condition where the scanning body 78 moves toward the right to approach to the carriage 12. The bifurcated claw of the gripper 62 is opened to enter within the claw I of the black gripper 75. FIG. 4C shows the condition where the scanning body 78 is located close to the carriage 12, the gripper 62 grips the gripping portion 36, and the claw I of the black gripper 75 is further deformed outwardly. Subsequently, when the scanning body 78 is moved toward the left as shown in FIG. 4D, the carriage 12 is integrated with the scanning body 78 and thus is capable of scanning. Thereafter, when the scanning body 78 is moved toward the right, the carriage 12 is moved from the scanning body 78 side to the black gripper 75 side conversely to the foregoing process. Thus, whenever the scanning body 78 approaches the black gripper 75, transfer of the carriage 12 is performed.

In FIG. 1, the reference numeral 77 denotes a cap for capping the printing head of the black ink cartridge 13 to protect the printing head from drying. Similarly, for the color ink cartridge 44, a cap (not shown) is provided. The cap 77 is moved by means (not shown), such as a cam, to contact with a head surface of the printing head of the black ink cartridge 13, when the carriage 12 for the black ink is held at the capping position by the black gripper 75. When restriction of the carriage by the black gripper 75 is released to permit the carriage 12 to move away from the black gripper 75, the cap 77 is retracted.

To the cap 77, a tube 103 as a flexible member is connected to communicate with the interior of the cap 77. The tube 103 is formed of a material, such as rubber or soft resin, so that it may be deformed and elastically returned to its initial configuration. The tube 103 extends in parallel to the scanning direction from the cap 77 to the lower side of the roller 101. Similarly, a cap (not shown) and tube 104 are provided for the color ink cartridge 44.

Figure 5B:
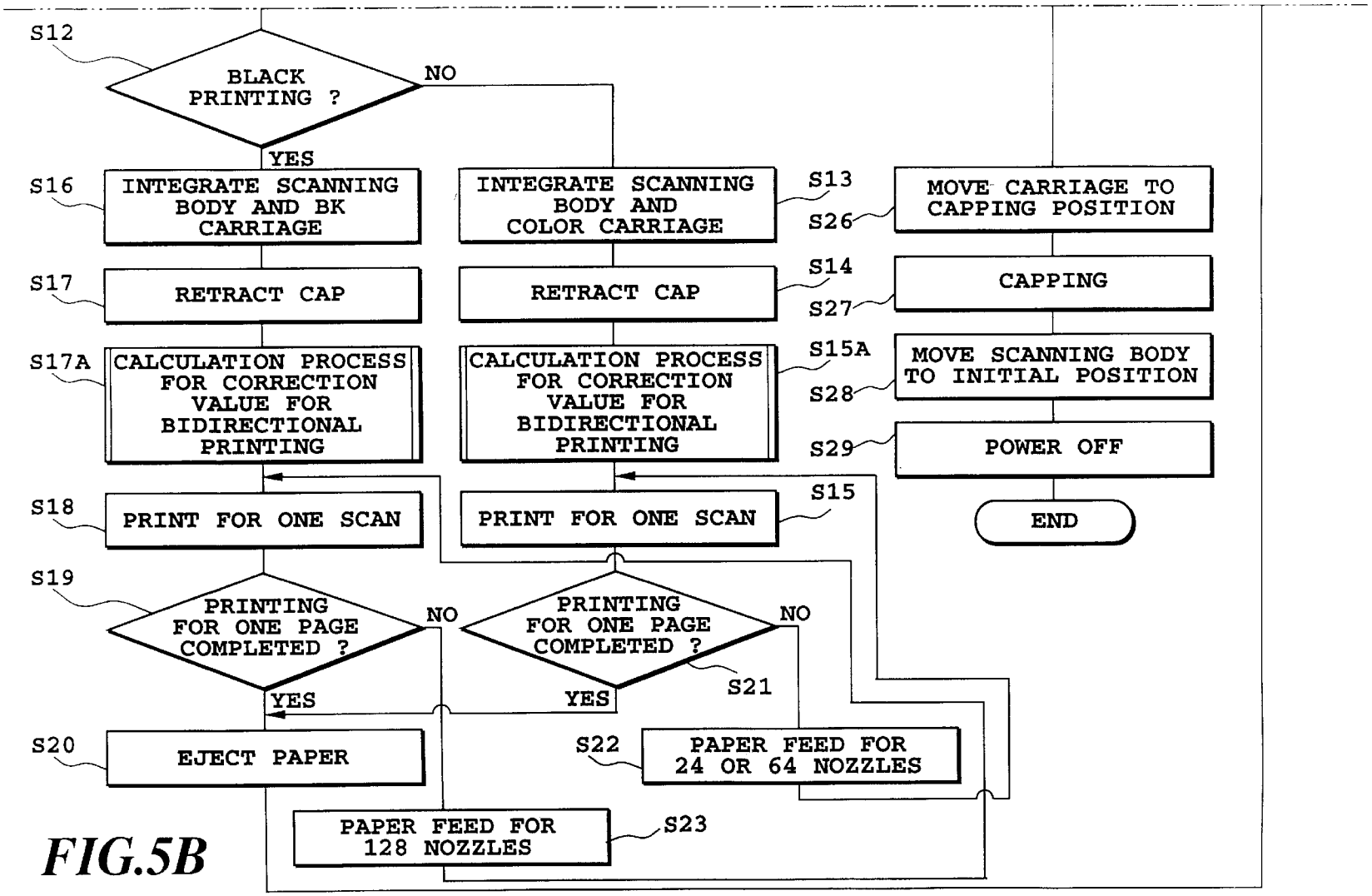

Next, operation will be explained with reference to FIGS. 1, 5A and 5B.

Before turning ON a power source, the scanning body 78 is stationary stopped at an initial position which is shifted 50 mm toward the left in FIG. 1 from the position where the blocking plate 66 blocks the optical path of the home position sensor 74. At this time, the carriage 12 for the black ink and the carriage 38 for the color ink are located at the respectively corresponding capping positions. The printing heads of these cartridges 13 and 44 are capped. Also, the roller 101 is held at the first position shown by the solid line in FIG. 8.

When the power source is turned ON, the scanning body 78 is rightwardly moved 100 mm toward the carriage 12 for the black ink (Bk side) (steps S1 and S2). At this time, the number of times of blocking of the optical path of the home position sensor (HP) 74 is counted. If the number of times of blocking of the optical path is one, the direction of motion of the scanning body 78 is reversed to move toward the left (step S5). The scanning body 78 is then stopped at the initial position, which is shifted 50 mm from the position where the optical path is blocked (step S6). On the other hand, when the optical path of the sensor 74 is blocked twice, a judgment is made that the carriage 12 for the black ink or the carriage 38 for the color ink is coupled to the scanning body 78. An output interval of detection signal of the sensor 74, namely a time interval from blocking of the optical path of the sensor 74 at the first time to blocking at the second time, is judged. In the condition where the scanning body 78 and the carriage 12 are coupled, the blocking plate 66 and the blocking plate 79 are arranged with a distance of 20 mm. On the other hand, in the condition where the scanning body 78 and the carriage 38 are coupled, a distance between the blocking plate 66 and the blocking plate 80 is 6 mm. Accordingly, when the optical path of the sensor 74 is blocked twice, a judgment can be made either that the carriage 12 or the carriage 38 is coupled to the scanning body 78 depending upon the time interval.

When the carriage 12 for the black ink (hereinafter referred to as Bk carriage or black carriage) is coupled to the scanning body 78, the scanning body 78 is scanned in the following manner. At first, after a timing, at which the blocking plate 66 passes across the sensor 74, the carriage 12 for the black ink is moved to the capping position by the scanning body 78 (step S4 and S11). The carriage 12 is restricted by the black gripper 75. Thereafter, the motion direction of the scanning body 78 is reversed to move toward the left (step S5). Then, after blocking of the optical path of the sensor 74 again, the scanning body 78 is stopped at the initial position (step S6). On the other hand~ when the carriage 38 for the color ink is coupled, the scanning body 78 is scanned in the following manner. At first, after a timing, at which the blocking plate 66 passes across the optical path of the sensor 74, the scanning body 78 is moved 50 mm toward the right. Then, the motion direction of the scanning body 78 is reversed to move toward the left (step S9). Thus, the carriage 38 for the color ink (hereinafter occasionally referred to as the color carriage) is moved to the capping position by the scanning body 78 (step S10). Then, the color carriage 38 is restricted by the color gripper 76. Thereafter, the scanning body 78 is again reversed the motion direction (step S5) and stopped at the initial position (step S6).

When the carriages 12 and 38 are not coupled to the scanning body 78, only the scanning body 78 is moved and stopped at the initial position. On the other hand, due to an unexpected event, where both of the carriages 12 and 38 are coupled to the scanning body 78 upon turning OFF of the power source, the carriages 12 and 38 are moved to their respectively corresponding capping position to be restricted and then, only the scanning body 78 is moved to stop at the initial position.

When a printing signal is input, judgment is made whether the printing signal is for a black base printing, such as text, rule lines or for a color image. In case of the former, the scanning body 78 is scanned to the capping position of the black carriage 12 and is coupled to the black carriage 12 (step S16). In a case of the latter, the scanning body 78 is scanned to the capping position of the color carriage 38 and is coupled to the color carriage 38 (step S13). When the cartridge 13 or 14 is coupled to the scanning body 78, the corresponding cap is retracted (steps S17 and S14).

Next, with respect to a printing operation using the coupled scanning body 78 and black carriage 12 or the coupled scanning body 78 and color carriage 38, arithmetic process for deriving a correction amount for bidirectional printing, which will be described later, is performed (steps S17A and S15A). The scanning body 78 and the carriage 12 or 38 to be coupled to the former are held by the bifurcated claws of the gripper 62. Therefore, when a load is exerted in a direction releasing the carriage 12 or 38 away from the scanning body 78, it should be inherent to cause a slight gap between the carriage 12 or 38 and the scanning body 78. A difference between a magnitude of play in the coupling position of the scanning body 78 and the carriage 12 and a magnitude of play in the coupling position of the scanning body 78 and the carriage 38 should affect the quality of a printing image. Similarly a difference of tension of the belt 65 between forward motion and reverse motion should affect the quality of printing an image. For example, in the ink-jet printer in the construction of the illustrated embodiment, upon performing bidirectional printing, a printing position in forward motion and reverse motion of the scanning body 78 may fluctuate to the extent of 2 mm. Such fluctuation should cause degradation of the image quality, such as fluctuation of a printing position of printed characters or misalignment of rule lines. In the illustrated embodiment, in case of such bidirectional printing, degradation of image quality is prevented by shifting a printing timing, i.e. ink ejection timing, during reverse motion of the scanning body 78 in a magnitude corresponding to the fluctuation.

Hereinafter, a calculation process (correction amount calculation process of -the bidirectional printing) of a period corresponding to the fluctuation (hereinafter referred to as "correction amount of bidirectional printing") will be described with reference to FIGS. 2 and 11. In a case of the color carriage 38, a similar operation is performed as to that of the case of the black carriage 12. Therefore, description is given only for the black carriage 12. Here, the carrier motor 71 is a pulse motor driven for an amount of time corresponding to a number of driving pulses.

At first, in the condition of step S16 of FIG. 5B, in which the scanning body 78 and the carriage 12 are coupled, the scanning body 78 is moved (step S51 of FIG. 11) toward the left (hereinafter referred to as "color side"). A timing, at which a left side edge portion 200 of the blocking plate 79 in FIG. 2 (hereinafter referred to as "correction edge") blocks the optical path of the home position sensor 74, is waited (step S52). Then, at the timing of the correction edge blocking, 200 driving pulses are applied to the carrier motor 71 for moving the scanning body 78 toward the left for a distance corresponding to 200 pulses. At the same time, a timer (not shown) for calculation of the correction amount is activated to initiate counting of an elapsed time. A precision in counting of the elapsed time is set to be ⅕ period of the pulse signal for the motor 71, for example. At a timing, at which the scanning body 78 is moved toward the left for a distance corresponding to 200 driving pulses, the counted value of the timer for calculation of the correction amount is stored in a memory (not shown) as a counted value "a" in the forward motion (step S53).

Subsequently, the motion direction of the scanning body 78 is reversed to move toward the right (step 54). At the timing of reversal of motion, the timer for calculating the correction amount is triggered. Thus, an elapsed time from the reversal timing of the scanning body 78 to the correction edge 200 detected by the sensor 74, is counted by a timer for calculating the correction amount. The counted value is stored in memory as counted value "b" in reverse motion (steps S55 and S56).

Subsequently, from the counted values a and b, a correction amount (a–b) is calculated. Then, applying a predetermined number of pulse signals to the carrier motor 71, the carriage 12 is moved to a printing start position (steps S57 and S58). The correction amount (a–b) becomes the bidirectional correction amount. By shifting the printing timing (ink ejection timing) in the bidirectional correction amount, fluctuations of printing position in bidirectional printing operation can be eliminated.

In order to calculate the correction amount in bidirectional printing, the reason to utilize the correction edge 200 of the blocking plate 79 of the driven side carriage 12 is to include a play component between the scanning body 78 and the carriage 12 in the bidirectional correction amount. In the case of the blocking plate 66 of the scanning body 78 is used in place of the blocking plate 79, the play component between the scanning body 78 and the carriage 12 is not included in the bidirectional correction amount. Accordingly, the carriage 12 can not be accurately corrected.

On the other hand, at step S58 after detection of the correction edge 200, even when the carrier motor 71 is moved the black carriage 12 to the printing start position by applying the predetermined number of pulse signals, the carrier motor 71 is controlled on the basis of a detection timing of the blocking plate 79 of the black carriage 12. Accordingly, the black carriage 12 can be accurately moved to the printing start position irrespective of the play component between the scanning body 78 and the carriage 12 and the fluctuation of dimension of the scanning body 78.

It is also possible to take the edge portion at the right side of the blocking plate 79 in FIG. 2 as the correction edge to count for obtaining the counted values a and b on the basis of detection timing of the correction edge by the sensor 74.

Figure 11:
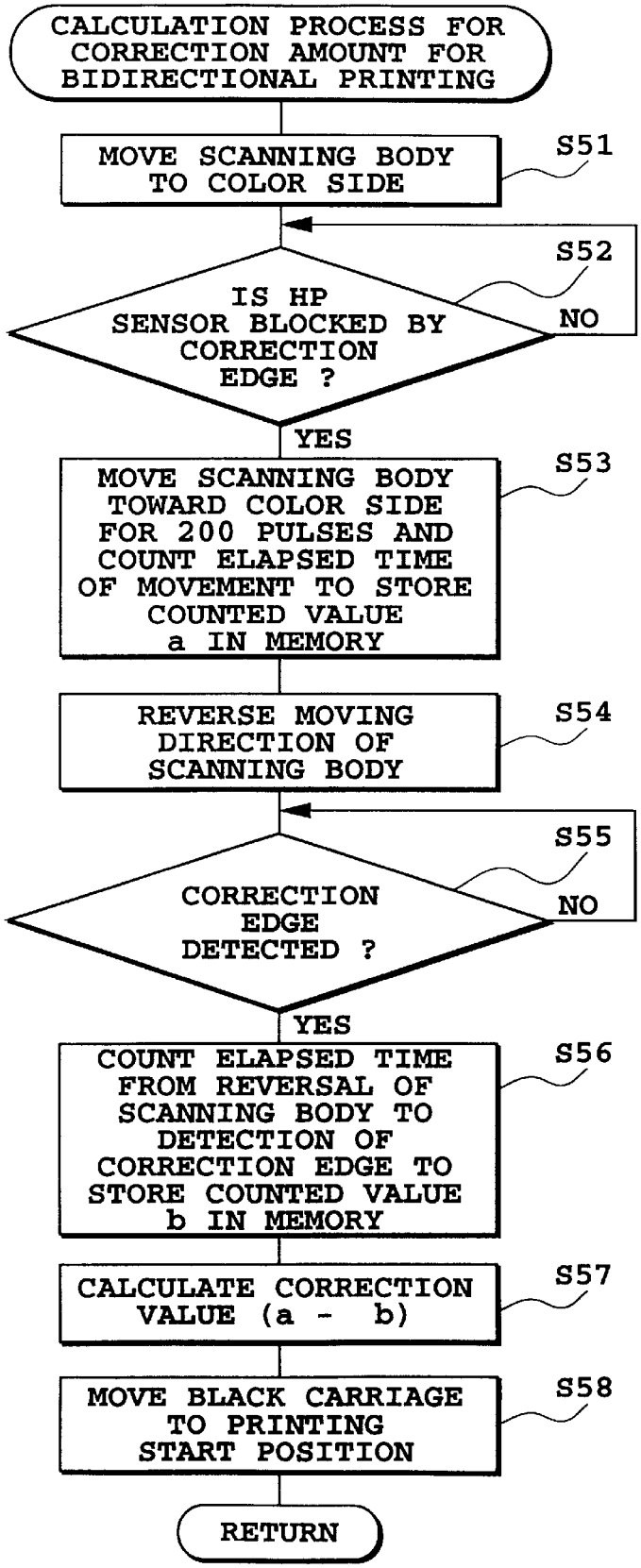
FIG. 11 is a flowchart for explaining a calculation process of a bidirectional printing correction amount of FIG. 5.

The correction amount calculating process for bidirectional printing in the case where the color carriage 38 is coupled to the scanning body 78, is similar to the process that is shown in FIG. 11. However, in this case, the blocking plate 80 of the color carriage 38 is used as the correction edge. Also, the motion direction of the scanning body 78 becomes opposite to that in the case of FIG. 11.

As set forth above, after calculation of the correction amount by the correction amount calculating process for the bidirectional printing, the printing timing is corrected on the basis of the correction amount to perform printing by the printing head of the black carriage 12 or the color carriage 38.

For example, in the printing by the printing head of the black carriage 12, the printing is performed by selectively ejecting the black ink through 128 ink ejection openings formed in the printing head. The ink ejection openings are formed in alignment along a direction substantially perpendicularly to the primary scanning direction. Thus, 128 nozzles can be formed. After printing for one scan corresponding to one line of printing width (step S18), the paper 9 is fed in a magnitude corresponding to a width of 128 nozzles, namely one line of printing width (steps S19 and S23). Then, a next scan is performed (step S18). Printing for one scan is completed by one printing scan in forward or reverse scanning motion in case of one path system, and by two times of printing scan both in forward and reverse scanning motion in case of two path system. When printing is completed for one page, the printing paper is ejected (steps S19 and S20). When printing is to be continued, new paper 9 is fed (steps S24 and S25). If printing is completed, the scanning body 78 moves the black carriage 12 to the capping position (step S6). The black carriage 12 is held by the black gripper 75. Then, after capping of the cap 77 (step S27), the scanning body 78 is moved to the position for turning OFF the power source and then stopped (step S28). Thereafter, the power source is turned OFF (step S29).

On the other hand, in case of printing by the printing head of the color carriage 38, for the printing region where a proportion of the color image is high, black, cyan, magenta and yellow inks are overlaid in sequential order. For the printing region of the black image, the black ink is ejected. The printing head of the color carriage 38 can be constructed as follows. Sixty-four (64) ejection openings which can eject the black ink are formed in alignment in a direction perpendicular to the primary scanning direction. On the phantom line parallel to the string of the ejection openings for the black ink, 24 cyan ink ejection openings which can eject the cyan ink, 24 magenta ink ejection openings which can eject the magenta ink, and 24 yellow ink ejection openings which can eject the yellow ink are arranged in alignment with a predetermined interval. Namely, on the phantom line, 24 cyan ink ejection openings, a space corresponding to 8 ejection openings, 24 magenta ink ejection openings, a space corresponding to 8 ejection openings and 24 yellow ink ejection openings are formed in sequential order. Each individual ejection opening forms a nozzle. When the printing head is constructed as set forth above, for the printing region having a large proportion of the color image, black, cyan, magenta and yellow inks are overlaid in sequential order with feeding the paper 9 in a magnitude corresponding to the width of the 24 nozzles. On the other hand, for the printing region of the black image, the black image can be formed with feeding the paper 9 in a magnitude corresponding to the width of 64 nozzles.

Figure 9:
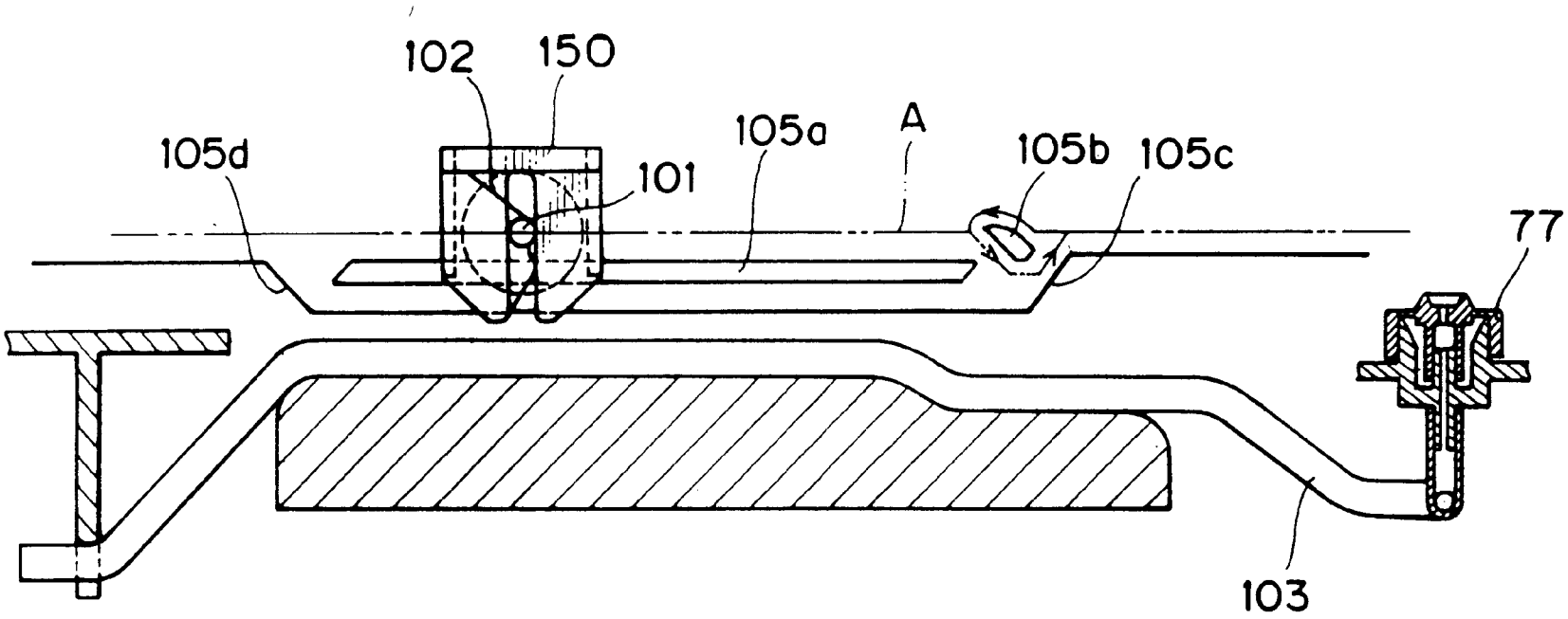
FIG. 9 is a front elevation of the major part showing a condition where the roller shown in FIG. 7 is not performing a pumping operation.

A relationship between the roller 101 and the cam 105 during printing operation is shown in FIG. 9. h The cam 105 is formed with cam portions 105*a*, 105*b*, 105*c* and 105*d* as shown. One dotted line identified by the reference sign A represents a motion trace of the center of the roller 101 while pumping is not performed. In FIG. 9, the roller 101 is illustrated in a condition before the power source is turned ON. At this condition, the roller 101 is located above the cam portion 105*a* in the transverse direction within a motion region during printing, and at the upper first position in the vertical direction. A small gap is left between the upper surface of the cam 105*a* and the roller shaft 101*a*. At this condition, the scanning body 78 is rightwardly moved toward the cap 77. When the scanning body 78 moves out of the scanning range for printing, the roller shaft 101*a* contact with the cam portion 105*b*. Then, the roller shaft 101 temporarily moves the lower second position along the arrow in the right lower direction. When the scanning body 78 continues to move toward the cap 77, the roller 101 is returned to the first position by the cam portion 105*c*. The roller 101 stops at a position where the printing head is placed in opposition to the cap 77. Subsequently, the motion direction of the scanning body 78 is reversed to move toward the left, the roller 101 is lifted up once by the cam portion 105*b*. Subsequently, the roller 101 is returned to the first position by the leaf spring 102. By further movement of the scanning body 78 toward left, the roller 101 is operated in a laterally symmetric manner to the foregoing explanation by a cam similar to the cam 105 provided at the side of the carriage 38 for the color ink. Therefore, as long as the scanning body 78 simply performs scanning from left to right or from right to left over the position of the cam portion 105*b*, the roller 101 may not contact the tube 103. The position where the cam 105*b* and the roller shaft 101*a* contact is out of the region for printing. Therefore, nothing will contact with roller 101 during printing. Therefore, cam 105 will never affect printing. It should be noted that the cam 105*b* may be provided within the region for printing as long as the cam does not affect printing.

Figure 10:
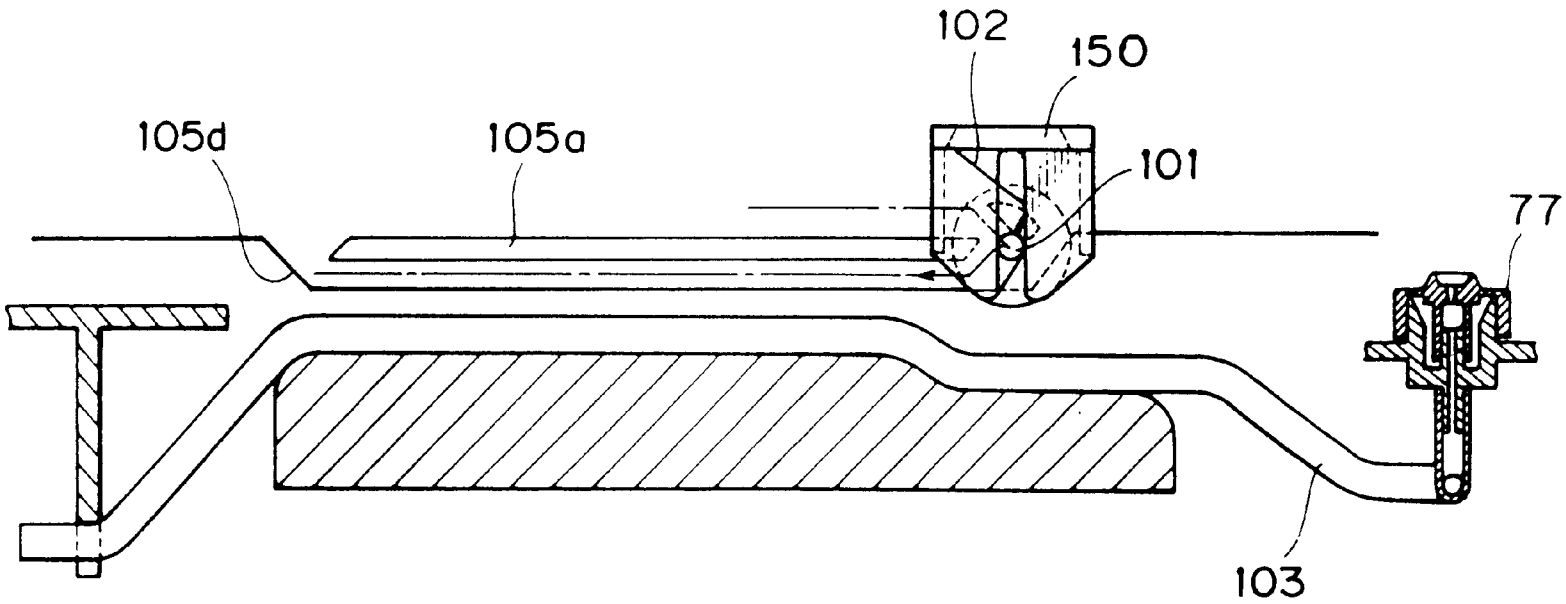
FIG. 10 is a front elevation of the major part in the condition of the roller starting the pumping operation.

Next, a pumping operation will be explained. FIG. 10 shows the condition where the roller 101 is moving to the lower second position by the cam portion 105*b*. When the scanning body 78 is moved toward the left from this condition, the roller 101 is forcedly depressed from the second position to a further lower third position by the cam portion 105*a*. By this, the roller 101 is guided by the lower side of the cam portion 105*a* to contact with the tube 103 to squeeze the latter. The tube 103 becomes air tight at the squeezed portion. When the roller 101 is moved toward the left at the third position below the cam portion 105*a*, a vacuum is generated within the tube 103 located at a right side of the roller 101. It should be noted that the roller 101 at the third position is located on a horizontal guide surface continuous to the cam portions 105*c* and 105*d* at the lower side of the cam portion 105*a* and thus will never loosen. By performing pumping by preliminarily capping the cap 77 on the black ink cartridge 13, the vacuum is applied to the ink ejection opening. Thus, the ink within the nozzle is forcedly sucked out until the vacuum is extinguished. After ejecting the ink, the roller 101 returns to the first position by the cam portion 105*d*. The moving position of the scanning body 78 during the pumping operation is controlled on the basis of the detection signal which is generated when the optical path of the sensor 74 is blocked by the blocking plate 66. Thereafter, the scanning body 78 and the carriage 12 for the black ink are coupled, the pumping operation is performed in a similar manner. At this time, since the cap 77 is opened to the ambient air, the ink within the tube 103 moves toward the left every time the tube is squeezed by the roller 101. By performing the pumping operation for several times with opening the cap 77 to the ambient air, all of the ink sucked within the tube 103 can be ejected from the left end. The ink is ejected from the color ink cartridge 44 by the same operation as that discussed above with reversing the lateral direction.

In the illustrated embodiment, the roller 101 is shifted in three stages between the first, second and third positions. When the roller 101 is moved in a lateral direction at the third position, the tube 103 is squeezed to perform pumping. However, such construction is not essential. For example, it is possible to shift the roller 101 in two stages between the first and second positions, to laterally move in the second position to squeeze the tube 103 to perform pumping. In this case, since it becomes necessary to move the roller 101 vertically in a significant magnitude by the cam portion 105*b*, the cam portion 105*b* has to be large. When the roller 101 is shifted in three stages by the cam portions 105*a* and 105*b*, the roller 101 can be shifted sufficiently and smoothly by the cam portions 105*a* and 105*b*.

When the ink is forcedly ejected from the ink ejection opening, the nozzles of the printing head and the filter within the ink cartridge 13, 44 serve as flow resistance. Thus, for completing ejecting of the ink, it normally takes one to three seconds. Therefore, it is preferred to wait for completion of ejecting of the ink by shifting the roller 101 toward the left at high speed, and by stopping the roller 101 at a position immediately before releasing engagement of the roller shaft 101*a* and the cam portion 105*a* at the left end side. In this manner, a greater vacuum is generated and is advantageous in removal of the dust adhering on the nozzle and removal of the ink with increased viscosity due to evaporation. Furthermore, during ejecting of the ink, by releasing the roller 101 from the left end of the cam portion 105*a* without waiting for completion of the ejecting, the ejecting amount of the ink can be controlled.

By ejecting the ink through the ink ejection openings, the printing head can be maintained in good condition. Such operation is referred to as a recovery operation. It may be possible to pressurize the ink in the printing head for ejecting the ink through the ink ejection openings.

On the other hand, due to resiliency of the bifurcated claws of the gripper 62, the scanning body 78 and the carriage 12 and 38 cannot easily be separated from one another. However, it can be considered that the scanning body 78 and the carriage 12 or 38 are separated from each other in a certain instance, such if the user touches then by hand. Therefore, monitoring is performed for checking whether the optical path of the sensor 74 is blocked twice at predetermined timings during one scanning cycle of forward and reverse scanning of the scanning body 78. If the optical path is blocked only once, judgment is made that the scanning body 78 and the carriages 12 and 38 are separated from each other. Then, the scanning body 78 is stopped to initiate a relief sequence. If a printing operation with the black carriage 12 has been performed immediately before the judgment of separation between the scanning body 78 and the carriages 12 and 38, the scanning body 78 is shifted toward the right for about 350 mm. During this movement, the gripper 62 contacts with the gripping portion 36 and pushes the black carriage 12 toward the right for shifting with maintaining contact between the gripper 62 and the gripping portion 36. Subsequently, the gripping portion 36 contacts with the bifurcated claws I of the black gripper 75 to make the black gripper 75 grip the gripping portion 36. When the scanning body 78 moves further right, the claws of the gripper 62 enter inside of the claws I of the black gripper 75. The carrier motor 71 causes step loss for a magnitude corresponding to a predetermined extra shifting amount and finally stops. Next, motion direction of the scanning body 78 is reversed together with the black carriage 12 to move toward the left. Then, after passing across the sensor 74, they stop at the initial position. At the same time, the platen roller 3 is driven to rotate to eject the paper 9, and new paper 9 is supplied to get ready for the next printing operation. On the other hand, when a printing operation with the color carriage 38 has been performed immediately before the judgment, the scanning body 78 is shifted toward the left in the magnitude of 350 mm. Subsequent processes are the same as that in the relief sequence of the black carriage 12 as set forth above. Thus, even when the scanning body 78 and the carriage 12 or 38 are separated due to an unexpected event, the relief sequence is performed automatically for enabling printing.

As set forth above, in the first embodiment, depending upon the kind of printing signal, namely depending upon the kind of image to be printed, an adapted carriage is selected to perform printing. Such selection may also be performed depending upon an operation mode of the printing apparatus. Also, in the illustrated embodiment, the head, in which cyan, magenta, yellow ink ejection openings are arranged in alignment as the printing head of the color ink cartridge 44, in comparison with the head, in which respective ejection openings for respective color inks are arranged in parallel, the width of the head in the primary scanning direction becomes smaller. As a result, the overall apparatus can be compact.

Also, in the illustrated embodiment, the first and second stand-by positions, where the carriages 12 and 38 are held, are provided at both end portions relative to the scanning direction of the scanning body 78. Thus, by scanning the scanning body 78 in one direction or the other direction, the carriage 12 or 38 can be easily selectively coupled to the scanning body 78. This contributes for simplification and down-sizing of the overall structure.

As clearly shown in FIG. 6, in the coupling condition of the scanning body 78 and the carriage 12, within a projection space of the carriage 12 in the perpendicular direction to the scanning direction of the scanning body 78, namely within the projection space of the cartridge 12 in the surface and back side surface direction on the sheet in FIG. 6, the intermediate portion in the lateral direction of the scanning body 78 can be included. As set forth above, the belt stop 64 (see FIG. 1) is the portion that receives the driving force of the scanning body 78 and is located at the laterally center position of the scanning body 78. As a result, the belt stop 64 is positioned within the projection space of the carriage 12. This permits a short distance between the belt stop 64 that receives the driving force and the gravity center of carriage 12. Accordingly, when the scanning body 78 together with the carriage 12 performs scanning, a moment to be generated between the belt stop 64 and the bearings 68 and 69 can be made small. This is advantageous from a viewpoint of smoothing the scanning operation. Also, the gripping position between the gripper 62 and the gripping portion 36 is located within the projected space of the carriage 12. Furthermore, upon scanning of the scanning body 78 together with the carriage 12, oscillation of the carriage 12 can be suppressed. This is similar to the case where the coupled condition of the scanning body 78 and the carriage 38 is established. In addition, an intermediate position in the lateral direction of the scanning body 78 is selectively included in the projection space of the carriage 12 or 38. Therefore, down-sizing can be achieved in the lateral direction.

Furthermore, upon coupling of the scanning body 78 and the carriage 12, it is desirable to preliminarily determine positioned relationships between the gripper 62 of the scanning body 78 side, the engaging shafts 59, 61 and 63, the gripping position 36 of the carriage 12 side, and the engaging holes 34, 33 and 35 in order to make the engaging order in the flowing order of sequence. At first, the engaging hole 35 as the elongated hole and the engaging shaft 63 are engaged. Thus, the carriage 12 can be positioned in the back and forth of the sheet in FIG. 6. Thereafter, the engaging holes 34 and 33 and the engaging shafts 59 and 61 are engaged. The carriage 12 is also positioned in the vertical direction. Then, or at substantially the same timing, the gripping portion 36 is engaged with the gripper 62. Thus, before gripping the gripper 62 to the gripping portion 36, restriction of the relative position of the carriage 12 and the scanning body 78 by positioning the carriage 12, is advantageous for assuring coupling between the carriage 12 and the scanning body 78. The above explanations also apply to coupling between the scanning body 78 and the carriage 38. In FIG. 1, for the engaging holes 40, 39 and 41 and the gripping portion 43 corresponding to the engaging shafts 60, 61 and 63, respectively, and the gripper 62 are given the reference signs E, F, G and H.

In the illustrated embodiment, the ink cartridges 13 and 44 are mounted on the carriages 12 and 38, yet the construction is not limited to the specific embodiment. For example, without employing the carriages 12 and 38, the cartridges 13 and 44 or the printing head per se may be selectively coupled to the scanning body 78. Also, as means for selectively coupling the carriages 12 and 38 to the scanning body 78 and means for constraining the capping position, the gripper 62 with bifurcated claws of resin is used. The invention should not be limited to the shown construction. For instance, a system to open and close the bifurcated claws by employing a solenoid, a method utilizing the suction force between the electromagnet and the metal may be included.

Also, the functional element is not limited to the printing head. For instance, by employing an image reading sensor as the functional element, an image scanner apparatus can be formed. It is also possible to make one of the carriages 12 and 38 as a carriage dedicated as the ink-jet printing head and to make the other carriage dedicated as the image reading head. Also, it is possible to form the carriages 12 and 38 with the same construction, and designate one of the carriages as a reserve. It is further possible to provide a reading head having resolutions of 300 dpi, 350 dpi, 600 dpi, 720 dpi to be exchangeable as the functional element. As the functional element, printing heads may be provided exchangeably. In this case, the printing head may be constructed to include high density black ink, yellow, magenta and cyan ink ejection, or low density black ink. Of course, as the printing head, various systems, including a system employing a thermal head, may be used.

Also, at the position of the end portion in the scanning direction of the scanning body 78, an automatic changer for selectively moving a plurality of functional element can be included. In this case, the functional element moved to the portion by the automatic changer, may be coupled to the scanning body 78.

Second Embodiment

In the foregoing first embodiment, the blocking plates 79, 80 and 66 are provided for the black carriage 12, the color carriage 38 and the scanning body 78, respectively, and these are used together with one home position sensor 74 to selectively detect the moving position of the carriages 12 and 38 or the scanning body 78. In contrast to this, in the second embodiment, by providing two home position sensors 74 at vertically different positions, one sensor may detect the carriage 12 and 38 and the other sensor may detect the scanning body 78. Also, corresponding to the positions of two sensors 74, the positions of respective blocking plates 79, 80 and 66 are differentiated. With such a construction, at the timing of blocking of the optical path of the sensor 74 for detecting the carriages 12 and 38, it can be judged that the carriage 12 or 38 is coupled to the scanning body 78. Therefore, it becomes unnecessary to make a judgment of the number of times of an occurrence of blocking of the optical path. Accordingly, when the optical path of the sensor 74 for detecting the carriage 12 or 38 is blocked, the position of the carriage 12 or 38 may be controlled on the basis of the detection signal. Discrimination of the black carriage 12 and the color carriage 38 may be done by varying the width of the blocking plates 79 and 80.

Third Embodiment

In the first embodiment, the home position sensor 74 is fixed to the main body of the apparatus, and the blocking plates 79, 80 and 66 are provided on the carriages 12, 38 and the scanning body 78, respectively. The same effect may be obtained with the construction, in which the blocking plates 79, 80 and 66 are projected from the main body of the apparatus, and the sensors 74 are provided on the carriages 12, 38 and on the scanning body 78, respectively. In this case, for electrical connection to the sensors 74 on the carriages 12 and 38, a flexible cable is connected, and for connection to the sensor 74 on the scanning body 78, a dedicated cable is added. In such case, the number of sensors and wires is increased. However, it becomes unnecessary to check the blocking timing of the optical path of the sensor 74 for making discrimination of the black carriage 12 and the color carriage 38. Also, by providing the blocking plate on the scanning body 78 and providing the sensor for detecting the scanning body 78 on the main body of the apparatus, increasing of number of cables can be restricted.

The present invention achieves a distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention. This structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads. For example, a recording head fixed to the main assembly of a recording apparatus, a conveniently replaceable chip type recording head which, when loaded on the main assembly of a recording apparatus, is electrically connected to the main assembly, and is supplied with ink therefrom, and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are not liquid when the recording signal is applied can be used. For example, inks can be employed that solidify at a temperature lower than room temperature and are softened or liquefied at room temperature. This is because in the ink jet system, the ink is generally temperature adjusted in a range of 30° C. 70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation. For example, the ink is transformed from a solid to a liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A device which includes a scanning type carrier for performing scanning by receiving a driving force, and a carriage which can be coupled to and released from said carrier and can mount a functional element, said device comprising:

detecting means for detecting said carriage in a coupled condition with said carrier, when said carrier passes a predetermined reference position in a scanning direction of said carrier; and control means for controlling an action of said functional element, based on a detection timing of said detection means, while said functional element is in an active state.

2. A device as claimed in claim 1, wherein said control means determines an actuation start timing of said functional element based on the detection timing of said detecting means.

3. A device as claimed in claim 1, further comprising:

guide means for guiding a reciprocal scanning motion of said carrier, wherein said control means calculates a correction amount of control of said functional element corresponding to a coupling play between said carrier and said carriage based on the detection timing of said detecting means when said carrier is reciprocally scanned by a predetermined amount.

4. A device as claimed in claim 1, wherein said carriage includes a first carriage which can mount a first functional element and which is located at a first side position in the scanning direction of said carrier, and a second carriage which can mount a second functional element and which is located at a second side position in the scanning direction of said carrier, wherein said first and second carriages are selectively coupled to said carrier.

5. A device as claimed in claim 4, wherein said detecting means detects said first carriage passing a predetermined reference position in the scanning direction of said carrier while said first carriage is coupled to said carrier, and detects said second carriage passing a predetermined reference position in the scanning direction of said carrier when said second carriage is coupled to said carrier.

6. A device as claimed in claim 5, wherein said control means determines an actuation start timing of said first functional element based on the detection timing of said detection means when said first carriage is coupled to said carrier, and determines an actuation start timing of said second functional element based on the detection timing of said detection means when said second carriage is coupled to said carrier.

7. A device as claimed in claim 5, wherein said control means calculates a correction amount for control of said first functional element corresponding to a coupling play between said carrier and said first carriage based on the detection timing of said detection means upon a reciprocal scan of said carrier by a predetermined amount while said first carriage is coupled to said carrier, and calculates a correction amount for control of said second functional element corresponding to a coupling play between said carrier and said second carriage based on the detection timing of said detection means upon a reciprocal scan of said carrier by a predetermined amount while said second carriage is coupled to said carrier.

8. A device as claimed in claim 1, further comprising:

carrier detecting means for detecting said carrier passing a predetermined reference position in the scanning direction of said carrier, wherein said control means controls the scanning of said carrier based on the detection timing of said carrier detecting means while said carriage is not coupled to said carrier.

9. A device as claimed in claim 8, wherein said detecting means also functions as said carrier detecting means.

10. A device as claimed in claim 1, further comprising:

carrier detecting means for detecting said carrier passing a predetermined position in the scanning direction of said carrier, wherein said control means controls the action of said functional element based on the detection timings of said detecting means and said carrier detecting means.

11. A device as claimed in claim 10, wherein said control means calculates a correction amount for control of said functional element corresponding to a coupling play between said carrier and said carriage based on the detection timings of said detecting means and said carrier detecting means when said carrier is reciprocally scanned.

12. A printing apparatus, which includes a scanning type carrier that receives a driving force for performing scanning in a primary scanning direction, transporting means for transporting a printing medium along an auxiliary scanning direction substantially perpendicular to the primary scanning direction, a carriage which can be coupled to and released from said carrier and can mount a printing head which can perform printing on the printing medium, said printing apparatus comprising:

detecting means for detecting said carriage passing a predetermined reference position in the primary scanning direction of said carrier while said carriage is coupled to said carrier; and control means for controlling an action of said printing head, based on a detection timing of said detecting means, while printing is performed on the printing medium using said printing head.

13. A printing apparatus as claimed in claim 12, wherein said control means determines an actuation start timing of said printing head based on the detection timing of said detecting means.

14. A printing apparatus as claimed in claim 12, further comprising:

guide means for guiding a reciprocal scanning motion of said carrier, wherein said control means calculates a correction amount of control of said printing head corresponding to a coupling play between said carrier and said carriage based on the detection timing of said detecting means when said carrier is reciprocally scanned by a predetermined amount.

15. A printing apparatus as claimed in claim 12, wherein said carriage includes a first carriage which can mount a first functional element and which is located at a first side position in the primary scanning direction of said carrier, and a second carriage which can mount a second functional element and which is located at a second side position in the primary scanning direction of said carrier, wherein said first and second carriages are selectively coupled to said carrier; and at least one of said first and second functional elements is the printing head.

16. A printing apparatus as claimed in claim 15, wherein said detecting means detects said first carriage passing a predetermined reference position in the primary scanning direction of said carrier while said first carriage is coupled to said carrier, and detects said second carriage passing a predetermined reference position in the primary scanning direction of said carrier while said second carriage is coupled to said carrier.

17. A printing apparatus as claimed in claim 16, wherein said control means determines an actuation start timing of said first functional element based on the detection timing of said detection means while said first carriage is coupled to said carrier, and determines an actuation start timing of said second functional element based on the detection timing of said detection means while said second carriage is coupled to said carrier.

18. A printing apparatus as claimed in claim 16, wherein said control means calculates a correction amount for control of said first function element corresponding to a coupling play between said carrier and said first carriage based on the detection timing of said detection means upon a reciprocal scan of said carrier by a predetermined amount while said first carriage is coupled to said carrier, and calculates a correction amount for control of said second functional element corresponding to a coupling play between said carrier and said second carriage based on the detection timing of said detection means upon a reciprocal scan of said carrier by a predetermined amount while said second carriage is coupled to said carrier.

19. A printing apparatus as claimed in claim 15, wherein another one of said first and second functional elements is a reading head which can read an image of an original.

20. A printing apparatus as claimed in claim 12, further comprising:

carrier detecting means for detecting said carrier passing a predetermined reference position in the primary scanning direction of said carrier, wherein said control means controls the scanning of said carrier based on the detection timing of said carrier detecting means while said carriage is not coupled to said carrier.

21. A printing apparatus as claimed in claim 20, wherein said detecting means also functions as said carrier detecting means.

22. A printing apparatus as claimed in claim 12, wherein said printing head is an ink-jet head for ejecting ink.

23. A printing apparatus as claimed in claim 22, wherein said ink-jet head has an electrothermal transducer for ejecting the ink by causing film boiling of the ink.

24. A printing apparatus as claimed in claim 12, Which further comprises recovery means for performing a recovery operation for maintaining said printing head in good condition by the scanning of said carrier.

25. A printing apparatus as claimed in claim 24, wherein said recovery means comprises a pump responsive to the scanning of said carrier, said pump generating a pressure for forcedly ejecting ink through ink ejection openings of said printing head.

26. A printing apparatus as claimed in claim 12, further comprising:

carrier detecting means for detecting said carrier passing a predetermined position in the printing scanning direction of said carrier, wherein said control means controls the action of said printing head based on the detection timings of said detecting means and said carrier detecting means.

27. A printing apparatus as claimed in claim 26, wherein said control means calculates a correction amount for control of said printing head corresponding to a coupling play between said carrier and said carriage based on the detection timings of said detecting means and said carrier detecting means when said carrier is reciprocally scanned.

* * * * *

UNITED STATES PATENT AND TRADEMARK OFFICE

CERTIFICATE OF CORRECTION

PATENT NO. : 6,164,755
DATED : December 26, 2000
INVENTOR(S) : Yamamoto

It is certified that error appears in the above-identified patent and that said Letters Patent is hereby corrected as shown below:

Column 1,
Line 30, "Japanese Patent Application" should read -- (Japanese Laid-Open Patent --.
Line 31, "Laying-open No. 164432/1994)." should read -- Application No. 8-25653).--.

Column 6,
Line 27, "7010" should read -- 700 --.

Column 9,
Line 14, "hand~" should read -- hand, --.

Column 10,
Line 11, "-the" should read -- the --.

Column 13,
Line 63, "then" should read -- them --.

Column 17,
Line 45, "consists" should read -- consist --.

Column 22,
Line 4, "Which" should read -- which --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*